US006929194B2

(12) United States Patent
Lawson

(10) Patent No.: US 6,929,194 B2
(45) Date of Patent: Aug. 16, 2005

(54) TURBINE SPEED CONTROL FOR ROTARY IRRIGATION SPRINKLERS

(75) Inventor: Kenneth L. Lawson, Rancho Cucamonga, CA (US)

(73) Assignee: Rain Bird Corporation, Glendora, CA (US)

( * ) Notice: Subject to any disclaimer, the term of this patent is extended or adjusted under 35 U.S.C. 154(b) by 0 days.

(21) Appl. No.: 10/365,956

(22) Filed: Feb. 12, 2003

(65) Prior Publication Data

US 2003/0150934 A1 Aug. 14, 2003

Related U.S. Application Data

(60) Provisional application No. 60/356,237, filed on Feb. 12, 2002.

(51) Int. Cl.[7] ..... B05B 15/10

(52) U.S. Cl. ..... 239/205; 239/240; 239/263

(58) Field of Search ..... 239/263, 263.3, 239/264, 265, 580, 201, 203, 204, 205, 206, 240

(56) References Cited

U.S. PATENT DOCUMENTS

| | | | | | |
|---|---|---|---|---|---|
| 3,854,664 | A | * | 12/1974 | Hunter | 239/206 |
| 3,940,066 | A | | 2/1976 | Hunter | |
| 4,201,344 | A | * | 5/1980 | Lichte | 239/242 |
| 4,253,608 | A | * | 3/1981 | Hunter | 239/206 |
| 4,625,914 | A | | 12/1986 | Sexton et al. | |
| RE32,386 | E | * | 3/1987 | Hunter | 239/206 |
| 4,892,252 | A | | 1/1990 | Bruninga | |
| 5,375,768 | A | * | 12/1994 | Clark | 239/210 |
| 5,695,123 | A | | 12/1997 | Le | |
| 5,927,607 | A | * | 7/1999 | Scott | 239/205 |
| 6,457,656 | B1 | * | 10/2002 | Scott | 239/205 |

* cited by examiner

*Primary Examiner*—Christopher Kim
(74) *Attorney, Agent, or Firm*—Fitch, Even, Tabin & Flannery

(57) ABSTRACT

In a turbine driven rotary irrigation sprinkler having a fixed stator with means for bypassing a portion of the water entering the sprinkler around the turbine so as to be able to adjust and control the rate of sprinkler rotation, the improvement of a rotatable stator cooperating with the fixed stator to provide infinite adjustability between the no bypass flow and full bypass flow conditions.

23 Claims, 3 Drawing Sheets

TURBINE SPEED CONTROL FOR ROTARY IRRIGATION SPRINKLERS

RELATED APPLICATIONS

This application is related to Provisional Application Ser. No. 60/356,237 filed Feb. 12, 2002.

BACKGROUND OF THE INVENTION

This invention relates to rotary irrigation sprinklers, and more particularly, to an infinitely adjustable by-pass opening for controlling of the speed of rotation of a turbine operated rotary sprinkler.

Water turbine rotary irrigation sprinklers, particularly of the pop-up type, having met with wide spread use in the irrigation industry, particularly where there is a need to irrigate large areas such as golf courses, parks, ball fields, and the like. Typically, such a sprinkler includes a housing that is adapted to be buried in the ground and attached to a pressurized water supply line, and a pop-up riser having one or more spray nozzles at one end, and a water driven turbine at the other. Disposed between the turbine and the nozzle is a speed reducing drive mechanism that converts the high-speed rotation of the turbine into lower speed nozzle rotation. The most common drive mechanism is that employing a gear reduction motor (typically referred to as a "gear drive" sprinkler), although there are also commercially available turbine drive sprinklers employing a ball-motor type mechanism. Exemplary of such sprinklers are the sprinklers sold by Rain Bird Corporation, the assignee of the present invention, under its designations, respectively, "T-BIRD" and "R-50." As used herein after, the designation "rotor" is intended to refer to any of the types of rotary irrigation sprinklers employing a water driven turbine coupled to a sprinkler nozzle through a speed reducing drive mechanism, although for purposes of discussion, the following will center around such rotors employing a gear drive mechanism.

There are many situations where it is desirable to be able to change the rate of nozzle rotation of a rotor. For example, in summer high heat conditions when the rotors are to be used for "cooling" the turf, it is desirable to use a very high rate of nozzle rotation, typically on the order of one revolution per minute or less, so as to cover the irrigated area in a short time. On other occasions, such as when irrigating in very dry conditions, it is desirable to have the rate of sprinkler rotation be relatively slow, such as on the order of five revolutions per minute as to achieve maximum distance of throw. In many situations, in order to adjust the rate of sprinkler rotation, the supply line pressure is controlled, and/or the size of the sprinkler nozzle is selected to achieve the desired rate of rotation.

Another way to control the rate of sprinkler rotation is to control the amount of energy supplied to the sprinkler turbine. In many rotors, pressure controlled by-pass openings are provided to permit a portion of the pressurized water to be directed around, rather than through, the turbine. The greater the amount of by-passed water, the less that flows through the turbine, thereby controlling the speed of turbine rotation, and hence, the speed of rotation of the sprinkler nozzle. Typically, however, these by-pass openings are controlled by pressure operated valves designed to achieve a relatively constant speed of sprinkler rotation, regardless of the pressure of the supplied water. Such pressure controlled by-pass valves are disclosed, for example, in U.S. Pat. Nos. 4,625,914; 4,892,252; and 5,695,123.

Hunter Industries of San Marcos, Calif., also commercially sells a line of rotors designated by its Model Nos. G-90 and G-95, and which employ settable by-pass openings intended to permit the speed of turbine rotation to be matched with the nozzle size and supply pressure. In these sprinklers, a stator sleeve having a half-circle by-pass opening in its radial face is secured to the riser below the turbine so that incoming pressurized water can be by-passed around a central passageway leading to the turbine. Concentrically mounted within and below the stationary stator is a settable stator sleeve, similarly having a half circle opening. The settable stator sleeve has a radially outwardly projecting key that is adapted to mate with one of a plurality of discrete keyway recesses formed in the side wall of the stationary stator sleeve. By manually removing the settable stator sleeve and repositioning it with its key positioned in one of the several discrete keyways within the stationary stator, the extent of the opening for by-pass flow can be selected in discrete increments from essentially a very small opening to a complete half circle opening. Notably, however, the settable stator sleeve can not be precisely adjusted to an infinite number of settings, but is confined to the preset locations of the keyway recesses in the stationary stator. Accordingly, only a very gross rotation rate adjustment is possible and limited by the number of discrete keyway recesses formed in the stationary stator sleeve.

It has been found, that in large irrigation projects, for example on golf courses, it is very desirable to be able to precisely adjust the speed of rotation of a rotor nozzle so that uniform irrigation over large areas is possible. One problem that has arisen is that as rotors age with use, they tend to slow in their rate of rotation at a given supply pressure. When used for golf course irrigation, even a relatively small rate of ration change from one rotor to another can have very dire consequences. Accordingly, there exists a need for rotors having the capability of quick, easy, and precise adjustment of the speed of rotation of the turbine so as to be able to precisely adjust the speed of nozzle rotation within small limits. As will become apparent hereinafter, the present invention satisfies that need in a novel and unobvious manner.

SUMMARY OF THE INVENTION

The present invention provides a mechanism for adjusting with a high degree of precision the rate of rotation of the turbine of a turbine driven sprinkler to obtain a very precise rate of nozzle rotation for a given supply pressure and nozzle size. More specifically, the present invention provides an infinitely adjustable stator opening for by-pass water flow that can be very quickly and easily set to very precisely control the rate of turbine rotation, and hence the rate of sprinkler nozzle rotation.

In this instance, the by-pass water is controlled by a stationary stator sleeve secured within the sprinkler riser below the turbine, and which includes a semi-circular by-pass opening which may be opened or closed by an infinitely adjustable rotary stator plate mounted within and below the stationary stator sleeve. The rotary stator plate includes a semicircular opening that can be rotatably adjusted relative to the stationary stator opening to selectively adjust the amount of by-pass flow permitted to flow through the stationary stator. A gear coupling is provided between the rotary stator plate and an adjustment pinion gear such that the stator opening can be very precisely positioned with respect to the by-pass opening in the stationary stator sleeve.

BRIEF DESCRIPTION OF THE DRAWINGS

The accompanying drawings illustrate the invention. In such drawings.

DETAILED DESCRIPTION OF PRESENTLY PREFERRED EMBODIMENT

Figure 1:
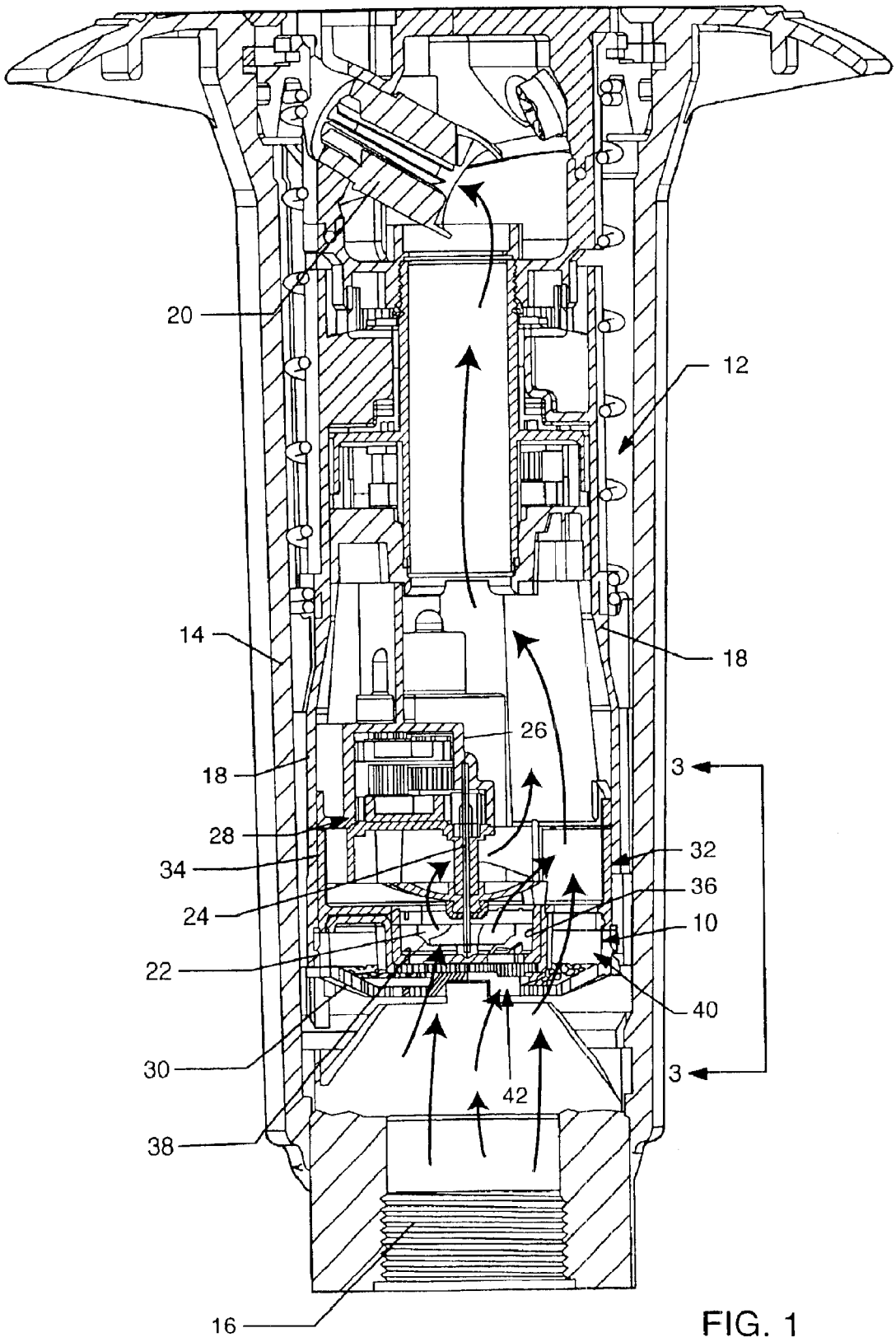
FIG. 1 is a longitudinal cross-sectional view of a turbine driven, gear drive rotor embodying the turbine speed control device of the present invention.

As shown in the exemplary drawings, the present invention is embodied in a new and improved speed control mechanism, generally designated 10, for use in controlling the rate of rotation of a turbine driven sprinkler or "rotor," herein generally designated 12. In this instance, as shown in FIG. 1, the rotor 12 includes a cylindrical housing 14 adapted to be buried in the ground, and having an inlet 16 at one end adapted to be coupled to a source of pressurized water (not shown), and within which is mounted the sprinkler unit, herein including a tubular pop-up riser 18 having a sprinkler nozzle 20 at its upper end, and a turbine 22 at its lower end. As is well understood by those familiar with such rotary irrigation sprinklers, pressurized water admitted to the inlet 16 of the housing 14 causes the riser 18 to extend so that the nozzle 20 is above the surrounding Ground, and water from the inlet is directed to flow past the turbine 22 through the riser to the nozzle.

Rotation of the nozzle 20 occurs as a result of a portion of the pressurized water being directed to the turbine 22 which is connected to the nozzle through a speed reducing mechanism 28, herein a gear motor mounted within a conventional water tight motor housing 26, and having a downwardly projecting drive shaft 24 attached to the turbine. The speed reducing mechanism 28 acts to convert the high speed of the rotating turbine 22 into a higher torque, lower speed rotation of the nozzle 20.

In this instance, as indicated by the directional arrows of FIG. 1, water entering the inlet 16 is directed upwardly through a screen filter 30 of conventional design, and then is directed to the speed control mechanism 10 which controls the amount of water that is by-passed around the turbine 22 directly into the riser 18 versus that which is directed to the turbine. Herein, the speed control mechanism 10 includes a stationary stator sleeve 32 having a generally donut-shape with an outer cylindrical side wall 34 secured within the inside wall of the tubular riser 18 adjacent its lower end, and an inner cylindrical side wall 36 disposed to surround the turbine 22. Interconnecting the outer and inner side walls 34 and 36 is a generally horizontally disposed web 38 having a semi-circular by-pass opening 40 formed therein. Water from the inlet 16 is directed to the turbine 22 through a central opening 42 formed inside the inner side wall 36, and water is directed through the semi-circular by-pass opening 40 in the web 38 so as to flow around the turbine to the nozzle 20.

Figure 2:
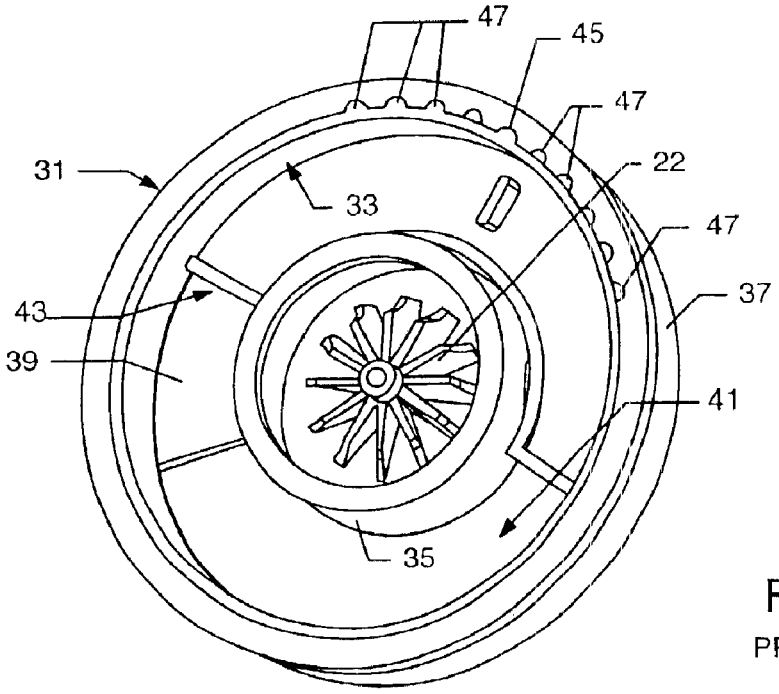
FIG. 2 PRIOR ART
FIG. 2 is an enlarged isolated perspective view of a prior art settable stator sleeve for selecting by-pass flow.
Figure 3:
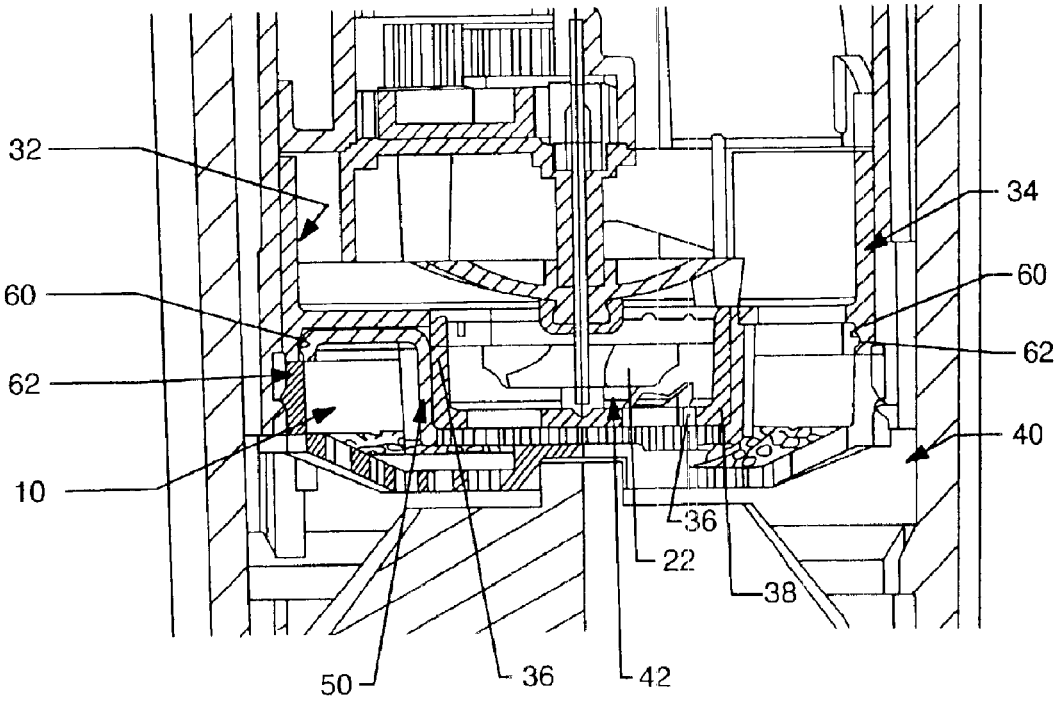
FIG. 3 is an enlarged, fragmentary sectional view taken substantially of the area along the line 3—3 of FIG. 1.
Figure 4:
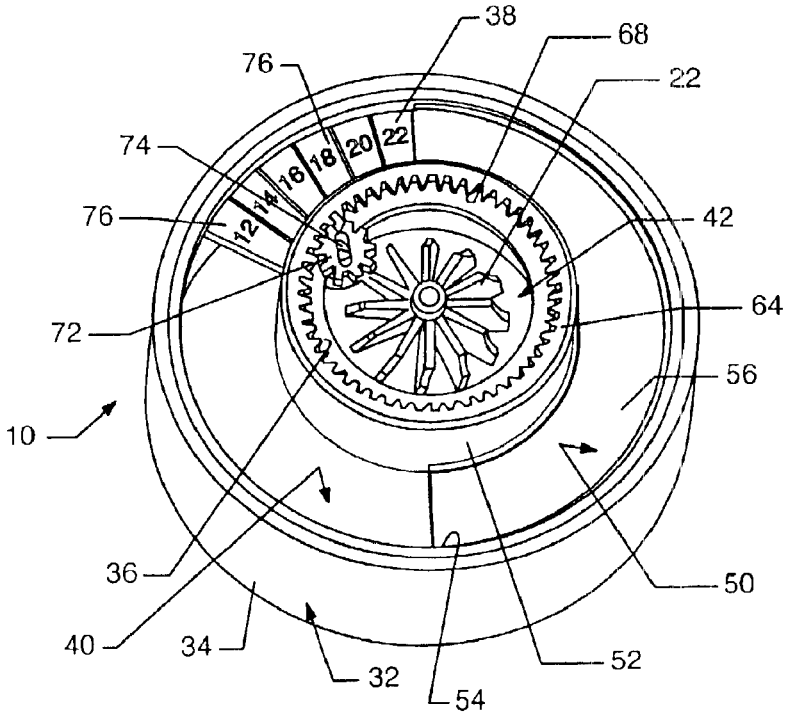
FIG. 4 is an enlarged isolated perspective view of the speed control device of the present invention as seen removed from FIG. 1.
Figure 5:
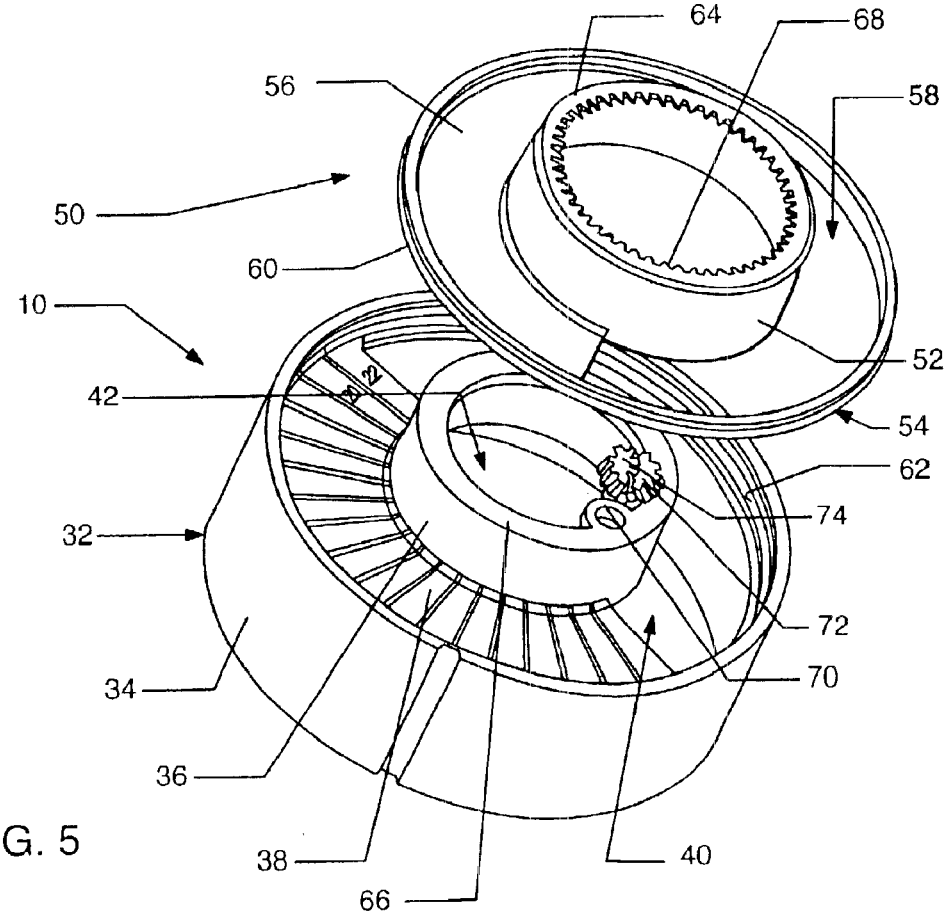
FIG. 5 is an exploded perspective view of the speed control device of FIG. 4.

Illustrated in FIG. 2 is a prior art settable by-pass stator opening of the type employed by Hunter Industries in its rotor Model Nos. G-90 and G95. As shown, the fixed stator sleeve 31, which is nonrotatably secured to the inside of the sprinkler riser (not shown) below the turbine 22, has a semi-circular by-pass opening 41 formed in a portion of the web 39 interconnecting inner and outer cylindrical sidewalls 35 and 37, respectively. Selectively positionable within the space between the inner and outer sidewalls 35 and 37 of the fixed stator sleeve 31 is a settable stator ring 33 having a semi-circular opening 43 sized to correspond with the size and shape of the opening 41 in the fixed stator. To adjust by-pass flow, the settable stator 33 includes a radially outwardly projecting rib 45 that is adapted to be seated within one of a plurality of slots 47 formed on the inner peripheral surface of the outer sidewall 37 of the fixed stator sleeve 31. By selecting one of the slots 47 within which to position the rib 45, the settable stator 33 can be positioned to block all or a portion of the by-pass opening 41 through the fixed stator sleeve 31. Notably, however, the ability to control the size of the bypass opening 41 through the fixed stator 31 is restricted by the number and spacing of the slots 47, thereby limiting the ability to control the speed of rotation of the turbine 22 to very limited discrete settings.

In accordance with the present invention, the speed control mechanism 10 permits the by-pass flow of water through the by-pass opening 40 to be quickly and easily adjusted to any of an infinite number of positions so as to very precisely control the rate of rotation of the sprinkler nozzle 20. In this respect, the speed control mechanism 10 is relatively simple and reliable in use, and is inexpensive to manufacture, yet provides a very reliable and effective means for very accurately and precisely controlling the speed of rotation of the sprinkler over very wide limits for any given water supply pressure and nozzle size.

Toward these ends, a rotatable stator plate 50 comprises inner and outer cylindrical side walls, 52 and 54, respectively interconnected by a flat face 56, and is disposed for relative rotation inside the outer side wall 34 of the stationary stator 32. The rotary stator 50 includes a semi-circular shaped opening 58 formed to be capable of coinciding in size with the by-pass opening 40 of the stationary stator 32 so that when aligned, the by-pass opening of the stationary stator is unobstructed. Herein, to rotatably mount the rotary stator plate 50 to the stationary stator sleeve 32, the rotary stator has a circumferential rib 60 formed around the outer side wall 54, and which is adapted to be received within a corresponding circumferential groove 62 formed on the inside of the outer side wall 54 of the stationary stator, the rib and groove being relatively positioned such that when the rotary stator is coupled to the stationary stator, the face 56 of the rotary stator abuts the underside of the web 38.

Rotation of the rotary stator plate 50 relative to the stationary stator sleeve 32 permits the extent of alignment of the opening 58 in the rotary stator plate to be changed relative to the by-pass opening 40 through the stationary stator sleeve. In this way, the amount of by-pass water can be controlled from the maximum with the two openings 58 and 40 aligned, to the minimum with the opening of the rotary stator disaligned with that of the by-pass opening of the stationary stator so that it is completely obstructed by the face 56 of the rotary stator plate. For any given water supply pressure and sprinkler nozzle 20, the greater the amount of water passing through the by-pass opening 40, the slower the speed of rotation of the turbine 22, and hence that of the sprinkler nozzle.

To permit precise and infinite adjustment of the alignment between the opening 58 of the rotary stator plate 50 and that of the bypass opening 40 in the stationary stator 32, the inner side wall 52 of the rotary stator is herein formed with a radially inwardly extending end wall or lip 64 adapted to overlie the lower end 66 of the inner wall 36 of the stationary stator sleeve. The end wall 64 is formed with radially inwardly directed gear teeth 68 extending around the inner periphery. Rotatably secured to a small radially inwardly directed tab 70 formed on the lower end 66 of the inner wall 36 of the stationary stator 32 is a relatively small diameter toothed pinion gear 72 disposed to have its teeth mesh with the teeth 68 of the rotary stator plate 50. Herein, a slot 74 of the type adapted to receive a screw driver blade, is formed in the outer end of the pinion gear 72 so that by inserting and turning the blade of a screw driver, the pinion can be rotated to rotate the rotary stator plate 50 and control the extent of alignment between the opening 58 of the rotary stator and that of the by-pass opening 40 of the stationary stator sleeve 32.

It should be apparent that with the relatively small diameter of the pinion gear 72 relative to the extend of the teeth 68 around the rotary stator 50, very small adjustments in the rotary stator plate relative to the stationary stator 32 are possible. Thus, it is possible to quickly and easily precisely adjust the amount of water that by-passes the turbine, and thus effect the rate of sprinkler nozzle rotation, simply by inserting a screw driver blade into the slot 74 of the pinion gear 72 and then turning the pinion to effect a very small incremental change in the position of the opening 58 of the rotary stator plate 50 with respect to that of the by-pass opening 40. Moreover, since the rotary stator plate 50 is freely rotatable relative to the stationary stator sleeve 32, the area of the opening through the by-pass opening 40 can be infinitely selected between the full open and full closed positions, thereby to maximize the ability to control the speed of rotation of the rotor at any given supply pressure and nozzle size.

From the foregoing, it should be apparent that the present invention provides an infinitely adjustable turbine speed control mechanism 10 for rotor-type sprinklers, and which is relatively easy to operate, simple in construction and reliable in use. Moreover, the present invention provides the ability to very precisely and accurately control the speed of rotation of a sprinkler nozzle in a very convenient and accurate manner, the adjustment being accomplished simply by removing the sprinkler riser 18 from the housing 14, and then using a screw driver to rotate the pinion gear 72 to turn the rotary stator plate 50 to the desired position. Additionally, if desired, indicia, herein shown as numbers 76 can be inscribed on the portion of the web 38 of the stationary stator 32 opposite the by-pass opening 40 to serve as approximate reference points for setting the position of the rotatable stator plate 50 to achieve specific rates of rotation for given nozzle sizes and supply pressures.

Although an embodiment has been described in detail for purposes of illustration, various modifications may be made without departing from the scope and spirit of the invention.

IN THE SPECIFICATION

From the foregoing, it should be apparent that the present invention provides a simple and effective way to precisely adjust and control the amount of bypass water flowing through a turbine driven sprinkler, and thereby precisely control the speed of sprinkler rotation. Moreover, as should also be apparent, the present invention is inexpensive to manufacture and highly reliable in use, making adjustments simple and quick while enhancing the overall efficiency of the sprinkler with which it is used. While a particular embodiment of the present invention has been set forth herein by way of example, one of ordinary skill in the art will readily recognize that various changes and modifications can be made without departing from the spirit and scope of the invention.

What is claimed:

1. In a rotary irrigation sprinkler having a housing with an inlet for attachment to a source of pressurized water, and a pop-up assembly mounted within the housing and moveable between a lower, in operative position and an upper, operational position with a portion of the assembly extending out of the housing, the pop-up assembly including a lower casing portion and an upper tubular riser portion having a nozzle attached to its upper end, the casing having a lower end for admitting water from the source into the casing, a turbine mounted for rotation within the casing, and a speed reducing assembly mounted within the casing and drivingly coupled to the turbine and to the riser whereby rotation of the turbine effects rotation of the riser relative to the housing, a water flow path defined between the casing inlet and the riser, a fixed stator plate disposed in the flow path between the casing inlet and the turbine and defining a first drive passage for directing a first portion of the water entering the casing upwardly to drive the turbine, and a second bypass passage for directing a second portion of the water entering the casing around the turbine, the improvement comprising:

a moveable stator plate rotatably coupled to said fixed stator, said rotatable stator having a wall portion adapted to overlie and occlude said bypass passage when said rotatable stator is in one rotary position relative to said fixed stator, and having a flow opening therein of a size and shape substantially the same as said second bypass passage such that when said rotatable stator is in a second rotary position relative to said fixed stator, the flow opening is aligned with said second bypass passage and water flowing through said second bypass passage is unobstructed, said rotatable stator being infinitely adjustable between said first and second rotary positions.

2. The improvement as set forth in claim 1, wherein said speed reducing assembly is a gear assembly.

3. The improvement as set forth in claim 1, wherein said second bypass passage has a generally arcuate shape.

4. The improvement as set forth in claim 1, wherein said first drive passage extends centrally through said fixed stator in axial alignment with said turbine.

5. The improvement as set forth in claim 4, wherein said second bypass passage is located to be concentric with said first drive passage and radially outwardly there from.

6. The improvement as set forth in claim 1, including means for adjusting the rotary position of said rotatable stator relative to said fixed stator.

7. The improvement as set forth in claim 6, wherein said means includes a gear connection between said rotary stator and said fixed stator.

8. The improvement as set forth in claim 7, wherein said fixed stator supports said gear for rotation about an axis parallel and said longitudinal axis, and said rotatable stator includes gear teeth engaged by said gear such that rotation of said gear effects rotation of said rotatable stator relative to said fixed stator.

9. The improvement as set forth in claim 8, wherein said gear is a pinion gear and said gear teeth are formed circumferentially around a radially inner portion of said rotatable gear.

10. The improvement as set forth in claim 9, wherein said pinion gear includes a slot for reception of a tool to effect rotation of said gear.

11. A rotary irrigation sprinkler comprising:

a housing having an inlet for attachment to a source of pressurized water;

a pop-up assembly mounted within the housing and moveable between a lower, in operative position and an upper, operational position with a portion of the assembly extending out of the housing, the pop-up assembly including a lower casing portion having an inlet for admitting water from the source into the casing, and an upper tubular riser portion having a nozzle attached to the upper end thereof;

a water driven turbine mounted for rotation within the casing;

a speed reducing assembly mounted within the casing and drivingly coupled to the turbine and to the riser whereby rotation of the turbine effects rotation of the riser relative to the housing;

a water flow path defined between the casing inlet and the riser;

a fixed stator plate disposed in the flow path between the casing inlet and the turbine and defining a first drive passage for directing a first potion of the water entering the casing upwardly to drive the turbine, and a second bypass passage for directing a second portion of the water entering the casing around the turbine; and a rotatable stator plate rotatably coupled to said fixed stator plate, said rotatable stator having a wall portion adapted to overlie and occlude said bypass passage when said rotatable stator is in one rotary position relative to said fixed stator, and having a flow opening therein of a size and shape substantially the same as said second bypass passage such that when said rotatable stator is in a second rotary position relative to said fixed stator, the flow opening is aligned with said second bypass passage and water flowing through said second bypass passable is unobstructed, said rotatable stator being infinitely adjustable between said first and said second rotary positions.

12. A rotary irrigation sprinkler as set for in claim 11, wherein said sprinkler defines a longitudinal axis about which said riser rotates and said turbine is mounted for rotation about said axis, said fixed stator and said rotatable stator being each generally cylindrical in shape with said first drive passage being centrally formed therein.

13. A rotary irrigation sprinkler as set forth in claim 12, wherein said second bypass passage has an arcuate shape and is formed concentrically with said first drive passage and radially outwardly there from.

14. A rotary irrigation sprinkler as set forth in claim 13, including adjusting the rotary position of said rotatable stator relative to said fixed stator.

15. A rotary irrigation sprinkler as set forth in claim 14, wherein said means includes a pinion gear rotatably coupled to said fixed stator and engaged with a ring gear formed on said rotatable stator.

16. A rotary irrigation sprinkler as set forth in claim 11, wherein said pinion gear includes means for receiving a tool to effect rotation thereof.

17. In a rotary irrigation sprinkler having a housing with an inlet for attachment to a source of pressurized water, and a pop-up assembly mounted within the housing and moveable between a lower, inoperative position and an upper, operational position with a portion of the assembly extending out of the housing, the pop-up assembly including a lower cylindrical casing portion and an upper tubular riser portion having a nozzle attached to its upper end, the casing having a lower inlet end for admitting water from the source into the casing, a turbine mounted for rotation within the casing about the centerline axis of the casing, and a speed reducing assembly mounted within the casing and drivingly coupled to the turbine and to the riser whereby rotation of the turbine effects rotation of the riser relative to the housing, a water flow path defined between the casing inlet and the riser, a fixed disc shaped stator plate disposed in the flow path between the casing inlet and the turbine and defining a first central drive passage for directing a first portion of the water entering the casing axially upwardly to drive the turbine, and a second bypass passage disposed coaxially with said first drive passage and radially outwardly thereof for directing a second portion of the water entering the casing inlet radially outwardly around the turbine, the improvement comprising:

a moveable stator plate rotatably coupled to said fixed stator, said rotatable stator having a wall portion adapted to overlie and occlude said bypass passage when said rotatable stator is in one rotary position relative to said fixed stator, and having a flow opening therein of a size and shape substantially the same as said second bypass passage such that when said rotatable stator is in a second rotary position relative to said fixed stator, the flow opening is aligned with said second bypass passage and water flowing through said second bypass passage is unobstructed, said rotatable stator being infinitely adjustable between said first and second rotary positions.

18. The improvement as set forth in claim 17, wherein said fixed stator includes an inner upstanding cylindrical wall defining said first central drive passage and a generally horizontally disposed portion extending radially outwardly there from said second bypass passage being formed in said horizontally disposed portion, and said rotatable stator includes an inner upstanding cylindrical wall portion engaged around said cylindrical wall of said fixed stator and rotatable relative thereto and a generally horizontally disposed web portion extending radially outwardly there from and overlying said horizontally disposed surface of said fixed stator.

19. The improvement as set forth in claim 18, wherein said second bypass passage in said fixed stator has a generally semicircular shape and is disposed to be concentric with said axis and radially outwardly there from.

20. The improvement as set forth in claim 19, wherein a pinion gear is rotatably supported by said inner upstanding wall of said fixed stator and said inner upstanding wall of said rotary stator includes teeth drivingly engaged with said pinion, whereby rotation of said pinion causes said rotatable stator to move relative to said fixed stator.

21. The improvement as set forth in claim 17, wherein indicia are provided on a portion of said horizontally disposed surface of said fixed stator and disposed to visible through said flow opening in said rotatable stator when said rotatable stator is in a rotary position between said first and second rotary positrons.

22. The improvement as set forth in claim 21, wherein said pinion gear includes means for reception of a tool to effect pinion gear rotation.

23. The improvement as set forth in claim 21, wherein said speed reducing assembly comprises a gear reduction assembly.

* * * * *

UNITED STATES PATENT AND TRADEMARK OFFICE

CERTIFICATE OF CORRECTION

PATENT NO. : 6,929,194 B2
APPLICATION NO. : 10/365956
DATED : August 16, 2005
INVENTOR(S) : Kenneth L. Lawson It is certified that error appears in the above-identified patent and that said Letters Patent is hereby corrected as shown below:

Column 6, lines 12-13, after “including” delete “a lower casing portion and an upper tubular riser portion having”.
Column 6, line 14, change “casing” to --pop-up assembly--.
Column 6, line 15, change “casing” to --pop-up assembly--.
Column 6, line 16, change “casing” to --pop-up assembly--.
Column 6, line 17, change “casing” to --pop-up assembly--.
Column 6, line 18, change “riser” to --nozzle--.
Column 6, line 19, change “riser” to --nozzle--.
Column 6, line 20, change “casing” to --pop-up assembly--.
Column 6, line 21, change “riser” to --nozzle--.
Column 6, line 22, change “casing” to --pop-up assembly--.
Column 6, line 24, change “casing” to --pop-up assembly--.
Column 6, line 26, change “casing” to --pop-up assembly--.
Column 7, line 8, after “including” delete “a lower casing portion having”.
Column 7, line 9, change “casing” to --pop-up assembly--.
Column 7, lines 9-10, after “and” delete “an upper tubular riser portion having”.
Column 7, line 13, change “casing” to --pop-up assembly--.
Column 7, line 14, change “casing” to --pop-up assembly--.
Column 7, line 15, change “riser” to --nozzle--.
Column 7, line 17, change “riser” to --nozzle--.
Column 7, line 18, change “casing” to --pop-up assembly--.
Column 7, line 19, change “riser” to --nozzle--.
Column 7, line 21, change “casing” to --pop-up assembly--.
Column 7, line 23, change “casing” to --pop-up assembly--.
Column 7, line 25, change “casing” to --pop-up assembly--.
Column 7, line 64, through Column 8, line 1, after “including” delete “a lower cylindrical casing portion and an upper tubular riser portion having”.
Column 8, line 1, change “casing” to --pop-up assembly--.
Column 8, line 3, change “casing” to --pop-up assembly--.
Column 8, line 4, in both instances, change “casing” to --pop-up assembly--.
Column 8, line 5, change “casing” to --pop-up assembly--.
Column 8, line 6, change “riser” to --nozzle--.
Column 8, line 7, change “riser” to --nozzle--.
Column 8, line 8, change “casing” to --pop-up assembly--.
Column 8, line 9, change “riser” to --nozzle--.
Column 8, line 10, change “casing” to --pop-up assembly--.
Column 8, line 12, change “casing” to --pop-up assembly--.

UNITED STATES PATENT AND TRADEMARK OFFICE

CERTIFICATE OF CORRECTION

PATENT NO. : 6,929,194 B2
APPLICATION NO. : 10/365956
DATED : August 16, 2005
INVENTOR(S) : Kenneth L. Lawson It is certified that error appears in the above-identified patent and that said Letters Patent is hereby corrected as shown below:

Column 8, line 16, change “casing” to --pop-up assembly--.

Signed and Sealed this

Second Day of October, 2007

JON W. DUDAS
*Director of the United States Patent and Trademark Office*